US008075129B2

(12) United States Patent
Kohne et al.

(10) Patent No.: US 8,075,129 B2
(45) Date of Patent: Dec. 13, 2011

(54) SYSTEM AND METHOD FOR OPTIMIZING PRINTING THROUGHPUT AND PRINT QUALITY BY EVALUATING IMAGE CONTENT

(75) Inventors: Jeffrey Russell Kohne, Tualatin, OR (US); Trevor James Snyder, Newberg, OR (US); Audrey Ann Lester, Sherwood, OR (US); Brent E. Fleming, Aloha, OR (US); Paul L. McConville, Webster, NY (US); Walter Sean Harris, Portland, OR (US); Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 463 days.

(21) Appl. No.: 12/415,885

(22) Filed: Mar. 31, 2009

(65) Prior Publication Data

US 2010/0245447 A1 Sep. 30, 2010

(51) Int. Cl.
*B41J 2/01* (2006.01)

(52) U.S. Cl. ..... 347/103

(58) Field of Classification Search ..... 347/103
See application file for complete search history.

(56) References Cited

U.S. PATENT DOCUMENTS

| | | | | |
|---|---|---|---|---|
| 5,353,107 | A | 10/1994 | Sculley et al. | |
| 6,035,157 | A | 3/2000 | Takahashi et al. | |
| 6,072,978 | A | 6/2000 | Wittmann | |
| 6,141,524 | A | 10/2000 | Berkes et al. | |
| 6,449,455 | B1 | 9/2002 | Lebold et al. | |
| 7,310,492 | B2 | 12/2007 | Kimura | |
| 7,362,994 | B2 | 4/2008 | Zess et al. | |
| 7,376,378 | B2 | 5/2008 | Van Bortel | |
| 7,458,671 | B2 | 12/2008 | Leighton et al. | |
| 2006/0239728 | A1 | 10/2006 | Van Bortel | |
| 2007/0020002 | A1 | 1/2007 | Zess et al. | |
| 2007/0040885 | A1 * | 2/2007 | Kusunoki | 347/102 |
| 2007/0109383 | A1 * | 5/2007 | Folkins et al. | 347/103 |
| 2007/0139496 | A1 | 6/2007 | Leighton et al. | |

* cited by examiner

*Primary Examiner* — Julian Huffman
(74) *Attorney, Agent, or Firm* — Maginot, Moore & Beck, LLP

(57) ABSTRACT

A method adjusts operation of a printer in accordance with an analysis of image content used to generate printed images. The method includes measuring image content of a first print image, comparing the measured image content to a predetermined threshold, and altering a print process parameter to adjust operation of a printer component in response to the measured image content exceeding the threshold.

19 Claims, 5 Drawing Sheets

SYSTEM AND METHOD FOR OPTIMIZING PRINTING THROUGHPUT AND PRINT QUALITY BY EVALUATING IMAGE CONTENT

TECHNICAL FIELD

This disclosure relates generally to imaging devices performing simplex or simplex and duplex printing, and more particularly, to such imaging devices that use release agent to facilitate transfer of an image from an image receiving member.

BACKGROUND

Droplet-on-demand ink jet printing systems eject ink droplets from print head nozzles in response to pressure pulses generated within the print head by either piezoelectric devices or thermal transducers, such as resistors. The ejected ink droplets, commonly referred to as pixels, are propelled to specific locations on a recording medium where each ink droplet forms a spot on the recording medium. The print heads have droplet ejecting nozzles and a plurality of ink containing channels, usually one channel for each nozzle, which interconnect an ink reservoir in the print head with the nozzles.

In a typical piezoelectric ink jet printing system, the pressure pulses that eject liquid ink droplets are produced by applying an electric pulse to the piezoelectric devices, one of which is typically located within each one of the ink channels. Each piezoelectric device is individually addressable to enable a firing signal to be generated and delivered for each piezoelectric device. The firing signal causes the piezoelectric device receiving the signal to bend or deform and pressurize a volume of liquid ink adjacent the piezoelectric device. As a voltage pulse is applied to a selected piezoelectric device, a quantity of ink is displaced from the ink channel and a droplet of ink is mechanically ejected from the nozzle associated with each piezoelectric device. The ejected droplets are propelled to pixel targets on a recording medium to form an image on an image receiving member opposite the print head. The respective channels from which the ink droplets were ejected are refilled by capillary action from an ink supply.

In some printers, the image receiving member is a rotating drum or belt coated with a release agent. The print head ejects droplets of melted ink onto the rotating image receiving member to form an image, which is then transferred to a recording medium, such as paper. The transfer is generally conducted in a nip formed by the rotating image member and a rotating pressure roll, which is also called a transfix roll. The pressure roll may be heated or the recording medium may be preheated prior to entry in the transfixing nip. As a sheet of paper is transported through the nip, the fully formed image is transferred from the image receiving member to the sheet of paper and concurrently fixed thereon. This technique of using heat and pressure at a nip to transfer and fix an image to a recording medium passing through the nip is typically known as "transfixing," a well known term in the art.

Ink jet printers are capable of producing either simplex or duplex prints. Simplex printing refers to producing an image on only one side of a recording medium. Duplex printing produces an image on each side of a recording medium. In duplex printing, the recording medium passes through the nip for the transfer of a first image onto one side of the recording medium. The medium is then routed on a path that presents the other side of the recording medium to the nip. By passing through the nip again, an image is transferred to the other side of the medium. When the recording medium passes through the nip the second time, the side on which the first image was transferred is adjacent to the transfix roll. Release agent that was transferred from the image receiving member to the recording medium may now be transferred from the first side of the recording medium that received an image to the transfix roll. Thus, a duplex print transfers release agent to the transfix roll and multiple duplex prints may cause release agent to accumulate on the transfix roll.

The amount of release agent on the transfix roll may reach a level that enables release agent to be absorbed by the back side of a recording medium while an image is being transfixed to the front side of the recording medium. If a duplex print is being made, the side of the recording medium receiving a second image may now have release agent on it. The release agent on the recording medium may interfere with the efficient transfer of ink from the image receiving member to the recording medium. Consequently, ink may remain on the image receiving member rather than being transferred to the recording medium. This inefficient transfer of ink may produce an image in which partial or missing pixels are noticeable. This phenomenon is known as image dropout. Additionally, ink remaining on the image receiving member may require the image receiving member to undergo a cleaning cycle. Otherwise, the ink not transferred from the image receiving member may interfere with the formation of a subsequent image on the image receiving member.

To aid in the transfer of ink from the image receiving member to the second side of a recording medium, some printers transfix all duplex images at a rotational speed that is slower than a rotational speed used for simplex printing. The slower speed exposes the medium in the nip to the pressure in the transfer nip longer and that exposure helps improve the efficiency of the image transfer to recording media having release agent on the surface of the media. The slower speed of the duplex printing process, however, reduces printer throughput during duplex printing operations. Therefore, performing duplex printing in a manner that improves throughput without subjecting image quality to dropout and the like is useful.

Application of release agent to the imaging member also affects image quality. When the applicator that applies release agent to the imaging member contacts the imaging member while it rotates at higher rotational speeds, more release agent is deposited on the imaging member. Slower rotational speeds result in less release agent being applied to the imaging member. Consequently, the imaging member speed also affects the amount of release agent available for absorption by the front side of a media sheet during a duplex printing cycle.

Excessive use of release agent not only contributes to image dropout, but may also shorten the life of a consumable module known as the cleaning unit. The process of applying release agent to the image receiving member, in terms of rotational speed and timing, also affects how much release agent is consumed during printing. Therefore, regulating the application of release agent to an image receiving member also contributes to conservation of release agent and extension of the operational life of the cleaning unit.

SUMMARY

A printer has been developed that monitors image content to be printed and controls the speed of the image receiving member for transfix and for application of release agent to the imaging member to achieve an optimized balance of image throughput, image quality, and release agent volume during printing. The printer includes a rotatable image receiving member having a coating of release agent thereon, a print head adjacent said rotatable image receiving member for ejecting ink droplets thereon to form ink images on said rotatable image receiving member, said ink images having a top edge, a transfix roll located adjacent said rotatable image receiving member and downstream from said print head, the transfix roll being adapted for movement towards and away from said rotatable image receiving member in order to form a transfixing nip periodically with the rotatable image receiving member, a release agent applicator configured for selective engagement with the rotatable image receiving member to apply release agent to the rotatable imaging member, and a controller configured to analyze image content of at least one print image and to modify a rotational speed of the rotatable image receiving member for at least one of a release agent application and a transfix operation in response to the image content of the at least one print image exceeding a predetermined threshold.

A method adjusts operation of a printer in accordance with an analysis of image content used to generate printed images. The method includes measuring image content of a first print image, comparing the measured image content to a predetermined threshold, and altering a print process parameter to adjust operation of a printer component in response to the measured image content exceeding the threshold.

In one embodiment, the method for adjusting printer operation based on image content alters the rotational speed of an image receiving member in response to an image content parameter exceeding a predetermined threshold. The method includes measuring image content for a first print image, comparing the measured image content for the first print image to a first predetermined threshold, and altering rotational speed for an image receiving member for at least one of a release agent application and a transfix operation in response to the image content score being greater than the predetermined first threshold.

BRIEF DESCRIPTION OF THE DRAWINGS

The foregoing aspects and other features of a system that evaluates image content of duplex images to control the rotational speed of the image receiving member and the transfix roll are explained in the following description taken in connection with the accompanying drawings.

DETAILED DESCRIPTION

Figure 1:
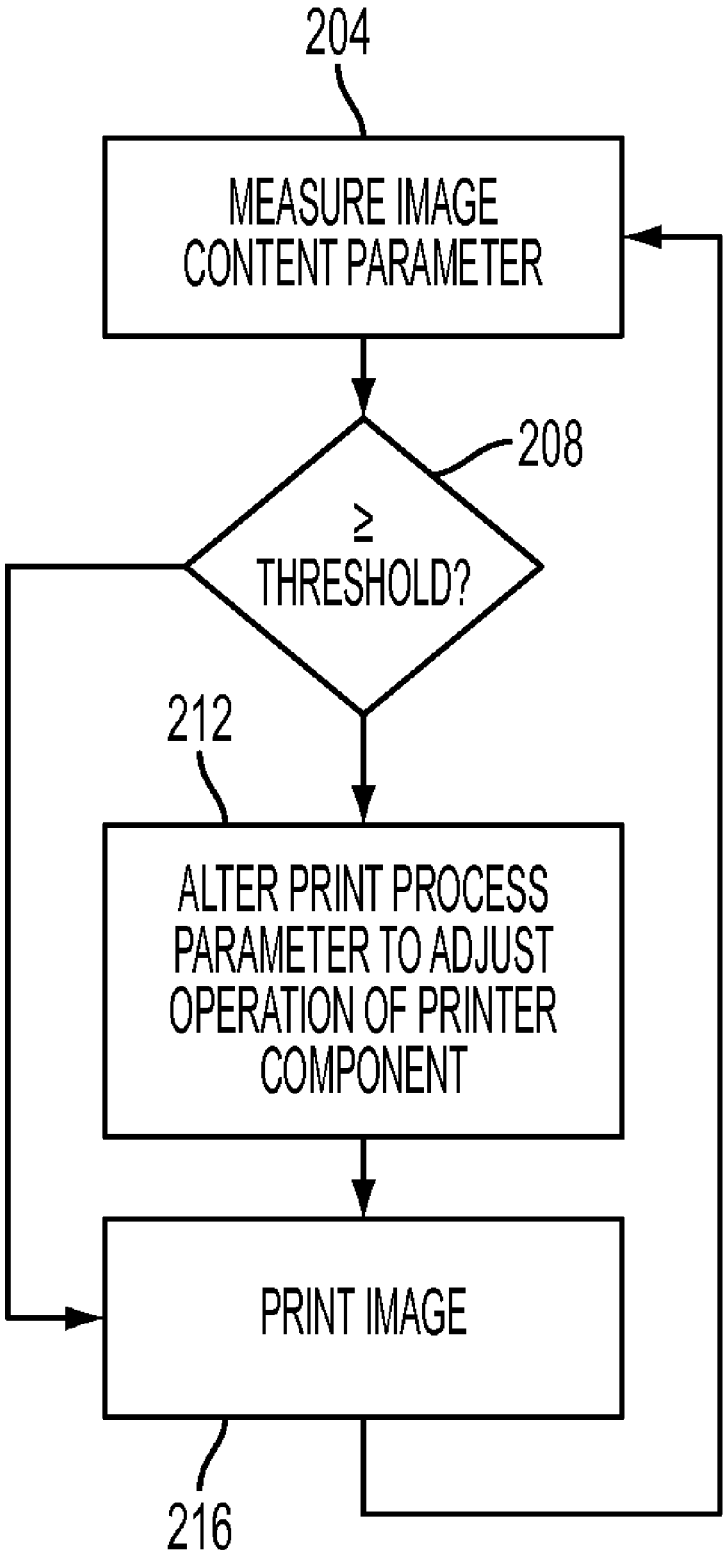
FIG. 1 is a flow diagram of a process that evaluates image content of images to be printed and alters printer component operation in accordance with a comparison of measured image content with at least one predetermined threshold.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system that monitors image content for both simplex and duplex printing and adjusts the transfer speed to help reduce the likelihood of image dropout while preserving overall throughput during the printing process. Additionally, regulation of the printing process with reference to the image content of the print images being produced aids in extending the operational life of the cleaning unit.

A process for altering operation of a printer to accommodate varying image content is shown in FIG. 1. The process begins with measurement of image content for an image to be printed (block 204). The term 'image content' is described in more detail below. Image content may be determined at certain times relative to operation based on sophistication or configuration of the printing device. As example, image content may be determined prior to actual imaging, such as by analysis of an image as it is "ripped", determined concurrent with imaging, such as by counting pixels, or determined after completing an image, such as by scanning the image on the offset drum before transfer or on media sheets, if directly printed or after transfer, if transferred from an imaging member.

With continued reference to FIG. 1, the measured image content parameter is compared to a predetermined threshold (block 208). If the measurement is less than the predetermined threshold, then the image is printed (block 216). If the measurement is equal to or greater than the predetermined threshold, then a print process parameter is altered to adjust operation of a printer component (block 212). The image is then printed (block 216). Print process parameters, also termed process profile, process control or similar term variations, may be adjusted independently for simplex and duplex operation, and may or may not be different depending on the full range of variables for the print process to be used to produce an image. Process parameters within those two basic modes of operation may be altered in limited fashion, such as the example discussed below, or may be very extensive, even though some profiles may be subtly different in some aspects. One example might be monitoring image receiving member temperature over a large batch print job where temperature could unavoidably rise above a nominal operation window and in response, the transfix velocity profile and transfix load may be altered. The change in process parameters in this example would not be optimized for image transfer efficiency or image quality results alone but rather, consistent with the focus of the systems and methods described herein, which may not be present in other implementations, may be performed as an optimization compromise between image quality, image throughput, and oil consumption.

One of the print process parameters altered below is described as velocity or speed of a rotating member. The term velocity or speed is used throughout this document as a reference to any steady state rate of motion, any varying motion due to acceleration or deceleration, or any combination of steady state, acceleration and deceleration motion throughout or during a portion of a particular operation of an image receiving member, or other motor driven component used in an imaging operation of the printer. For example, while a lower speed or velocity may be used to provide an advantage under some circumstances, a higher velocity or speed may be useful for other circumstances. Such a reference could also be understood to mean multiple different speeds, continuously variable speed profiles, and so forth. The range of variables contributing to attaining maximum throughput in conjunction with minimal compromise to image quality and oil consumption offer challenges for any particular imaging system and image job so these variables are not subject to strict formulation. Rather, the variables selected and their value ranges are flexible for intelligent automated optimization of the imaging process. The variables include but may not be limited to motion control, transfix load, image density by region of the image, color content, simplex or duplex printing, number of image repetitions, thermal changes over applicable conditions (environment or duration of print job), media type, number of images to be produced in a given job, and the intended image quality based on resolution. Consequently, numerous process profiles may be employed to attain the best balance of objectives, including those affected by user input, such as media type and image resolution. Central to these print parameter adjustment factors is knowledge about the images being produced. Intelligent action taken based on image analysis may therefore be partly formulation, where optimization is based upon known trends, and partly unique observation based on a given system, where weighting and values may be assigned to those trends within practical limits of a particular product implementation.

When measuring image content, the printer being described is being operated with reference to the image content of one or more print images used to generate ink images. These images may be denoted as a current print image, a previous print image, or a next print image. As used herein, the terms print image and current print image refer to the image being executed. The term next print image refers to an image that may have been at least partially processed by the controller, but not yet executed. Next print image may also be understood as "no subsequent print job," if no immediate print job follows the current image. The term previous print image refers to a print that has already been executed, and a measurement of its image content retained in a form that enables the measurement to be used to alter the print process of the current print image. In the context of a duplex print image, the current print image may be the first side printed and the next print image may be the second side printed. The term executed refers to the process in which the printer implements making a print by, for example, applying release agent to an image receiving member, ejecting ink from one or more printheads to form an ink image on the image receiving member, and transfixing the ink onto a recording medium, such as a sheet of media, by feeding the recording medium between a nip formed by the image receiving member and a movable transfix roll.

As used in this document, measuring image content of a print image refers to a process in which the attributes of a print job are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of attributes include, but are not limited to, the total number of pixels in an area to be executed, the number of pixels within specified areas of a total image to be executed, the relationship between the ink on the image receiving member and the media or other printer components, the quantity or occurrence of pixel patterns in a print image, the nature of the colors present, or the like. The logical decisions and analysis performed with reference to the attributes may be the same or different based on whether the image is a current print image, a next print image, or a previous print image. For example, comparison of an image content measurement to a predetermined threshold may use the same or different thresholds for current print images, next print images, or previous print images. Additionally or alternatively, other criteria such as duty cycle or a thermal state may be used to govern a logical decision or analysis. Also, comparisons described in this document are frequently described as exceeding a threshold. This description is meant to encompass the value being greater than the threshold or less than the threshold depending on the context of the comparison. Thus, exceeding a threshold may refer to a value greater than a maximum in one context and referring to a value less than a minimum in another context.

Figure 5:
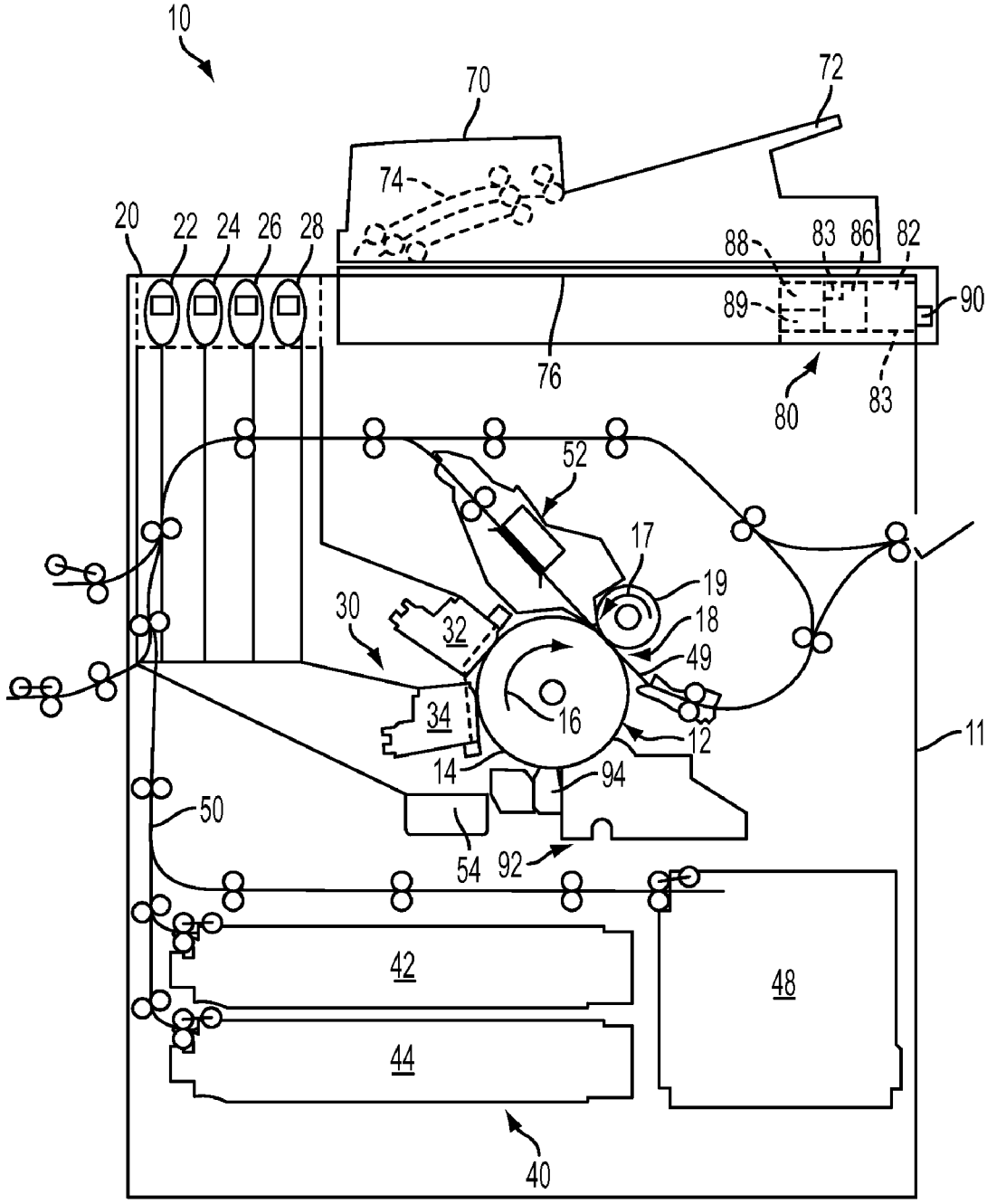
FIG. 5 is a schematic, side elevation view of an ink jet printer that implements the process shown in FIG. 1.

Referring now to FIG. 5, an embodiment of an image producing machine, such as a high-speed phase change ink image producing machine or printer 10, is depicted. As illustrated, the machine 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roll 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g., two (2)) of separate printhead assemblies 32 and 34 as shown, although the number of separate printhead assemblies may be one or any number greater than two.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead assemblies 32 and 34. As such, the ESS or controller 80 is the main multi-tasking processor for operating and controlling all of the other machine subsystems and functions, including the duplex printing process discussed below.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the processes, described more fully below, that enable the generation and analysis of printed test strips for the generation of firing signal waveform adjustments and digital image adjustments. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 and handled by substrate system 50 in timed registration with image formation on the surface 14. Finally, the image is transferred from the surface 14 and fixedly fused to the image substrate within the transfix nip 18.

In some printing operations, a single image may cover the entire surface of the imaging member 12 (single pitch) or a plurality of images may be deposited on the imaging member 12 (multi-pitch). Furthermore, the images may be deposited in a single pass (single pass method), or the images may be deposited in a plurality of passes (multi-pass method). When images are deposited on the image receiving member 12 according to the multi-pass method, under control of the controller 80, a portion of the image is deposited by the print heads 32, 34 during a first rotation of the image receiving member 12. Then during one or more subsequent rotations of the image receiving member 12, under control of the controller 80, the print heads deposit the remaining portions of the image above or adjacent to the first portion printed. Thus, the complete image is printed one portion at a time above or adjacent to each other during each rotation of the image receiving member 12. For example, one type of a multi-pass printing architecture is used to accumulate images from multiple color separations. On each rotation of the image receiving member 12, ink droplets for one of the color separations are ejected from the print heads and deposited on the surface of the image receiving member 12 until the last color separation is deposited to complete the image. In some cases, for example those using secondary or tertiary colors, one ink droplet or pixel may be placed on top of another one, as in a stack. Another type of multi-pass printing architecture is used to accumulate images from multiple swaths of ink droplets ejected from the print heads. On each rotation of the image receiving member 12, ink droplets for one of the swaths (each containing a combination of all of the colors) is applied to the surface of the image receiving member 12 until the last swath is applied to complete the ink image. Both of these examples of multi-pass architectures perform what is commonly known as "page printing." Each image comprised of the various component images represents a full sheet of information worth of ink droplets which, as described below, is then transferred from the image receiving member 12 to a recording medium.

In a multi-pitch printing architecture, the surface of the image receiving member is partitioned into multiple segments, each segment including a full page image (i.e., a single pitch) and an inter-document zone or space. For example, a two pitch image receiving member 12 is capable of containing two images, each corresponding to a single sheet of recording medium, during a revolution of the image receiving member 12. Likewise, for example, a three pitch intermediate transfer drum is capable of containing three images, each corresponding to a single sheet of recording medium, during a pass or revolution of the image receiving member 12.

Once an image or images have been printed on the image receiving member 12 under control of the controller 80 in accordance with an imaging method, such as the single pass method or the multi-pass method, the exemplary ink jet printer 10 converts to a process for transferring and fixing the image or images at the transfix roll 19 from the image receiving member 12 onto a recording medium 49. According to this process, a sheet of recording medium 49 is transported by a transport under control of the controller 80 to a position adjacent the transfix roll 19 and then through a nip formed between the movable or positionable transfix roll 19 and image receiving member 12. The transfix roll 19 applies pressure against the back side of the recording medium 49 in order to press the front side of the recording medium 49 against the image receiving member 12. Although the transfix roll 19 may also be heated, in this exemplary embodiment, it is not. Instead, a pre-heater for the recording medium 49 may be provided in the media path leading to the nip. The pre-heater provides the necessary heat to the recording medium 49 for subsequent aid in transfixing the image thereto, thus simplifying the design of the transfix roll. The pressure created by the transfix roll 19 on the back side of the heated recording medium 49 facilitates the transfixing (transfer and fusing) of the image from the image receiving member 12 onto the recording medium 49.

The rotation or rolling of both the image receiving member 12 and transfix roll 19 not only transfix the images onto the recording medium 49, but also assist in transporting the recording medium 49 through the nip formed between them. Once an image is transferred from the image receiving member 12 and transfixed to a recording medium 49, the transfix roll 19 is moved away from the image receiving member 12 and the image receiving member 12 continues to rotate and, under the control of the controller 80, any residual ink left on the image receiving member 12 is removed by well known drum maintenance procedures at a maintenance station 92. Also, applications of release agent, such as, for example, silicone oil, are selectively applied to the surface of the image receiving member 12 by the release agent applicator 94, prior to subsequent printing of images on the image receiving member 12 by the print heads in assemblies 32, 34. The primary function of the release agent is to prevent the ink from remaining adhered to the image receiving member during transfixing when the ink is being transferred to the recording medium. Typically, the release agent applicator includes a reservoir of release agent and a resilient donor roll, which may be smooth or porous and rotatably mounted in the reservoir for contact with the release agent and a compliant metering blade. The donor roll and metering blade are selectively moved by the controller 80 into temporary contact with the rotating image receiving member 12 to deposit and distribute release agent on the surface of the member.

In one embodiment, two modes of applying release agent to the imaging member are used. In the "overlap with image" mode, the imaging member is accelerated to an imaging rotational speed, which in one embodiment is approximately 1900 mm/second, while the release agent applicator and metering blade contact the imaging member. When the imaging member reaches the imaging speed, the applicator and then the blade are disengaged from imaging member and the imaging member is ready to receive ink images. In the "on the fly" mode, the imaging member is brought to and held at a release agent application speed, which is less than the imaging rotational speed. In one embodiment, the release agent application speed for the on the fly mode is approximately 500 mm/second. The slower speed enables the metering blade to remove release oil from the imaging member more effectively so less release agent remains on the imaging member. After the applicator and blade are disengaged from the imaging member, the member is brought to a higher imaging speed.

Release agent also aids in the protection of the transfix roll. Small amounts of the release agent are transferred to the transfix roll and this small amount of release agent helps prevent ink from adhering to the transfix roll. Consequently, a minimal amount of release agent on the transfix roll is desirable. In the systems described herein, the transfix roll does not have a release agent application system, but instead obtains release agent from the front side of a duplex print or from intentional contact with the image receiving member. The amount of release agent delivered by the front side of a duplex print depends upon the amount of ink on that side because ink typically carries more release agent than bare media as described in more detail below. Additionally, rotational contact of the transfix roll and image receiving member may be used to apply a desired release agent film to the transfix roll. Intentional contact between the transfix roll and the image receiving member may be achieved by actuating the transfix roll and timing the contact period as part of the normal print process, when desired as part of a special process, or at specified operation states or intervals, such as every fifty prints, as part of a printer's power-on and/or power-off sequence, or the like. Alternatively, the transfix roll may have its own release agent application system.

Too much release agent on a transfix roll, however, presents two issues. The first issue is excessive release agent consumption, which causes a shorter operational life for the cleaning unit. The second issue is referred to as image dropout. Fortunately, release agent may also be removed from the transfix roll during transfix operations. Essentially, the media wicks release agent away from the transfix roll. Thus, the amount of release agent on the transfix roll can be managed with reference to the parameters involved in the transport of release agent to and from the transfix roll and in context with simplex and duplex images.

Printing speed for simplex printing by ink jet printers is typically a priority, but the printing speed for duplex prints is also important. As noted above, however, the image quality for duplex prints may not be as good as simplex prints because of image dropout arising from the presence of release agent on the back side of a sheet during printing of the second image on the sheet. "Back side" as used herein refers to the side of the media opposite the one to which a first image of a duplex image is being transfixed.

To address the image quality issues that may arise from the presence of release agent on a media surface during duplex printing, a process has been developed that adjusts the speed of the image receiving member 12 and the transfix roll 19 selectively for both imaging and application of release agent to the imaging member. The speed adjustment is based on the content of the images to be printed. As is well known, a digital representation of an image to be printed is generated in a memory of the printer 10 and used for generation of the firing signals that selectively activate the actuators in the print heads of the assemblies 32, 34 that eject ink onto the image receiving member 12. The digital representation of an image is comprised of addressable pixels. By counting the number of pixels for which ink is to be ejected, the controller 80 is able to determine the amount of ink that is transferred to a media sheet during a transfix operation. The transferred ink also has release agent on it as the release agent was interposed between the imaging member 12 and the ink ejected onto the member. When the media sheet is reversed for printing of the back side in duplex printing, this release agent comes into contact with the transfix roll 19. After the duplex printed sheet leaves the transfix nip, the back side of the next media sheet is brought into contact with the release agent left on the transfix roll 19. When this back side is presented to the imaging member for transfer of an image in a duplex printing operation, the release agent on the media sheet may interfere with the transfer of ink from the imaging member 12 to the media sheet. As noted above, this release agent may result in a phenomenon known as image dropout. Because the release agent is carried by the ink, evaluating the amount of ink, which corresponds to the number of pixels, is useful for identifying printing operations that benefit from slower imaging member and transfix roll speeds to reduce the amount of release agent applied to an imaging member and to attenuate the occurrence of image dropout.

In a simplest form, the process counts the number of pixels for a duplex print image to be printed on a front side of a media sheet. If the number of pixels is greater than a predetermined threshold, then the imaging member may be operated in the "on the fly" mode for the application of release agent to the imaging member to reduce the exposure of the imaging member to release agent. Additionally, the imaging member and transfix roll are rotated during the transfer of the next image to the back side of the next media sheet at a rotational speed that is slower than the speed at which the imaging member and transfix roll rotate during a simplex printing operation. The threshold may be established empirically by observing a correlation between the number of pixels printed in an image and the appearance of image dropout.

While this simplest form of the process helps address image dropout, other parameters of the duplex printing process may be evaluated as well. For example, the front side and back side image of the first duplex image and the front side of the second duplex image in a stream of duplex images may all be printed at the rotational speed used for simplex printing.

The back side of the second duplex image is the first image to be formed on a sheet having release agent deposited on the sheet by the transfix roll. Thus, the back side of the second media sheet is the first sheet that may have received enough release agent to cause image dropout when an image is transferred to that side. Consequently, the second image of a duplex image may be transferred to the media sheet by rotating the imaging member and transfix roll at a rotational speed that is less than the simplex speed. The amount of release agent on the transfix roll for subsequent sheets, however, is not only dependent on the amount of release agent deposited by the front sides of duplex printed sheets, but also by the amount of release agent removed by the back sides of sheets as they pass the transfix nip for the first time. Thus, maintaining a historical record corresponding to the amount of release agent deposited on the transfix roll as well as the amount removed is useful for determining whether the rotational speed of the imaging member and transfix roll should be adjusted. Note that the transfix roll rotational speed is based on surface velocity of the driven imaging member, which presses against the transfix roll to form a high force nip.

Another factor affecting the amount of release agent on the transfix roll that may result in image dropout is the density of the ink on a media sheet. For example, prints of images having a relatively solid background area or banner, rather than text alone present ink in relatively dense proportions to a media sheet and, consequently, transfer release agent in a relatively dense manner to the transfix roll. Thus, evaluating image content to detect areas dense with pixels enables the application of the release agent to the imaging member to be performed at a slower speed to reduce the amount of release agent deposited on the imaging member. This reduction, in turn, reduces the amount of release agent transferred to a media sheet by the denser portions of the ink image.

Figure 2:
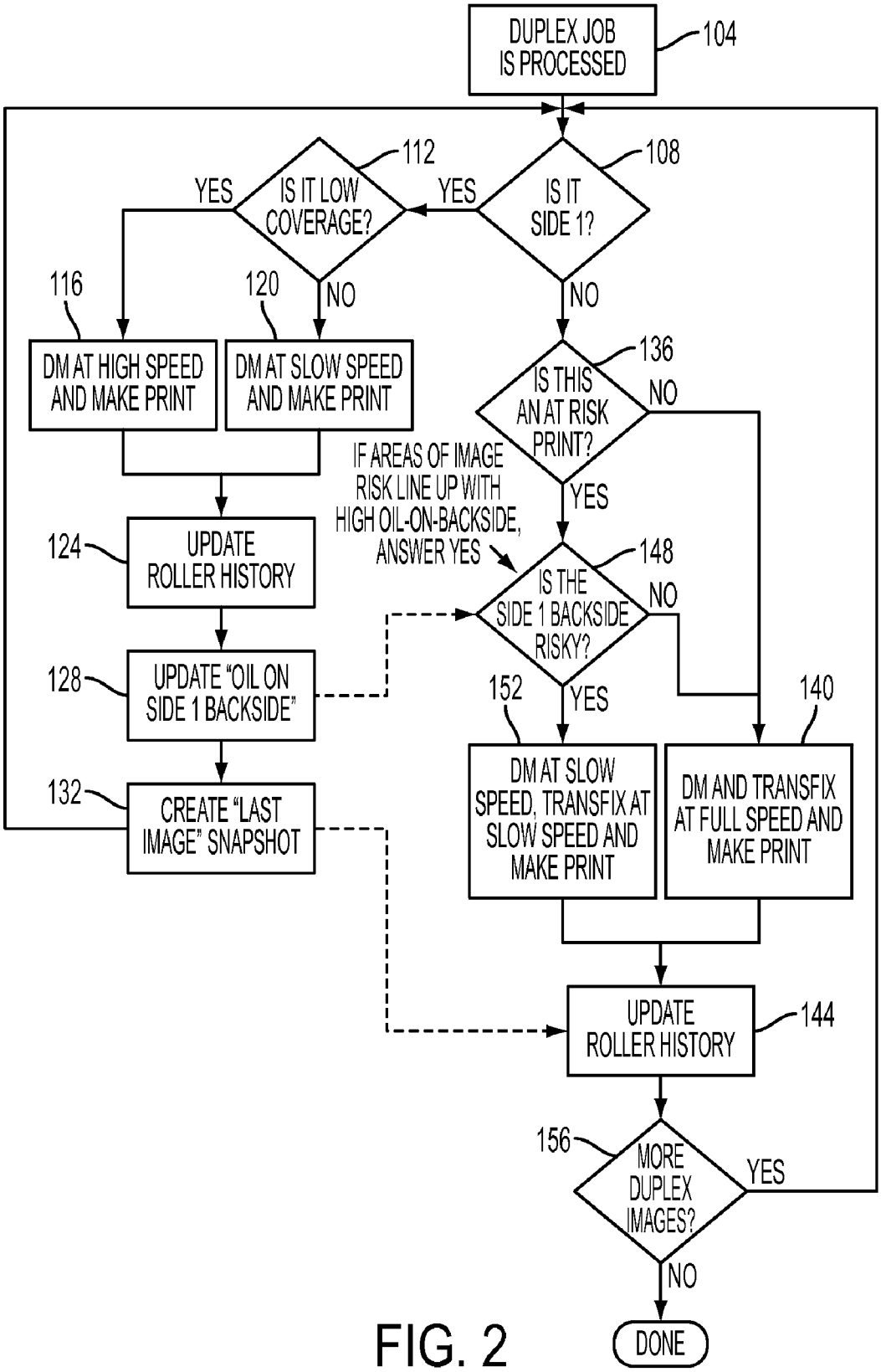
FIG. 2 is a flow diagram of a method that evaluates image content of duplex images to control the rotational speed of at least one of the image receiving member and the transfix roll.

A method that takes into account factors such as image density and the trends of release agent accumulation and removal on the transfix roll is shown in FIG. 2. As shown in the figure, the process begins by detecting a stream of duplex printing operations to be performed (block 104). This particular process may not be utilized during simplex only printing because release agent accumulation would not be expected. The process determines whether the first image of a duplex print is being processed (block 108). If it is, the process determines whether the first image has a number of pixels to print that warrants an adjustment in rotational speed of the imaging member and transfix roll (block 112). If the ink coverage is low, release agent application is performed in the "overlap with image" mode and printing of the image is achieved with the imaging member and transfix member being operated at simplex operational speed (block 116). Otherwise, the imaging member is operated in the "on the fly" mode for the application of release agent and the imaging member and transfix member are operated at a slower speed for transfixing of the image (block 120). An historical record of release agent exposure for the transfix member is updated (block 124) and the process updates a record regarding the amount of release agent on the back side of the media sheet being printed (block 128). The dotted line in the figure indicates the use of this information in the portion of the process that determines the rotational speed to be used for printing the back side of the media sheet. The process then generates a last image record (block 132), which is explained in more detail below, and continues to evaluate the parameters for the second image of the duplex image (block 108).

In evaluating the conditions for the printing of the second image on the back side of the media sheet, the process determines whether the image content transfers an appreciable amount of release agent to the media sheet and whether the amount of release agent on the back side of the media sheet presents a risk of image dropout. The process first evaluates whether the image content will result in an appreciable amount of release agent being transferred to the back side of the media sheet (block 136). If the image content is not dense, then the release agent is applied in the "overlap with image" mode and the imaging member and transfix roll are operated at simplex speed for the transfix operation (block 140). The historical record for the transfix roll is then updated using the last image record (block 144). If the image content indicates a risk of image dropout, then the process determines whether the amount of release agent on the media sheet exceeds a predetermined threshold (block 148). If the amount of release agent on the back side of the media sheet does not exceed the predetermined threshold, the release agent is applied to the imaging member using the "overlap with image" mode and the imaging member and transfix roll are operated at the simplex speed for the transfix operation (block 140). The historical record for the transfix roll is then updated using the last image record (block 144). If the amount of release agent on the back side of the media sheet indicates image dropout may occur with the amount of release agent being transferred with the ink image is greater than the predetermined threshold, then the release agent is applied to the imaging member in the "on the fly" mode and the imaging member and transfix roll are operated at a slower speed for the transfix operation (block 152) before the historical record for the transfix roll is updated (block 144). The process checks for more duplex images to process (block 156). If other duplex images require processing, the process continues (block 108). Otherwise, the process is completed until another set of duplex images is ready for printing.

More details of the process are now described. In order to evaluate a density of release agent presented to a transfix roll better, the transfix roll is evaluated as a plurality of regions. In one embodiment, a transfix roll is evaluated as having twelve regions defined with reference to the center line of the sheet. In this embodiment, the following table describes the twelve regions:

| | Zone # | | | | | | | | | | | |
|---|---|---|---|---|---|---|---|---|---|---|---|---|
| | −167 | −136.5 | −106 | −79.5 | −53 | −26.5 | 0 | 26.5 | 53 | 79.5 | 106 | 136.5 |
| Start dist. from CL (mm) | −136.5 | −106 | −79.5 | −53 | −26.5 | 0 | 26.5 | 53 | 79.5 | 106 | 136.5 | 167 |
| End dist. from CL (mm) | −167 | −136.5 | −106 | −79.5 | −53 | −26.5 | 0 | 26.5 | 53 | 79.5 | 106 | 136.5 |

These roller regions may be designated as rz1, rz2, . . . , rz12 beginning at the left edge and continuing to the right edge. An array for a current image is also set up with twelve regions that correspond to the twelve roller regions. These current image regions may be designated by ci1, ci2, . . . , ci12. Similarly, a last image array is set up with twelve regions corresponding to the sheet and current image array and designated as li1, li2, . . . , li12. Also, a sheet 1 backside array is set up with twelve regions corresponding to the twelve regions of the media sheet, current image, and last image arrays and designated as sb1, sb2, . . . , sb12. All of the cells in these arrays are initialized to a value of 1 in one embodiment.

To analyze an image, the percentage of pixels that result in ink being printed onto a media sheet is calculated by counting the number of pixels that will result in ink being printed, dividing that number by the total number of pixel locations in the region, and multiplying by one hundred. The percentage for each region is compared with a predetermined threshold that represents a percentage of printed pixels that may result in image dropout. In one embodiment, the predetermined threshold is represented by two thresholds. Specifically, the percentage of pixels to be printed in a region is compared to 5 percent and 20 percent. In response to the percentage being less than 5 percent, the current image array cell for the region is set to zero, while the current image cell for the region is set to the value 2 if the percentage is greater than 20 percent. If the percentage is between these two values, then the current image cell for the region is set to one. These predetermined thresholds may be different values for the first image and the second image of a duplex image. In response to any cell having a value of two, the rotational speed of the imaging member is reduced to the "on the fly" mode speed for application of the release agent. In one embodiment, the "on the fly" mode speed is 500 mm/second. As can now be seen, a predetermined threshold may be one of multiple thresholds, each of which may be values that are updated based on the content and nature of the previously completed image or an evaluated current image prior to a particular print process operation. These one or more maintained and updated predetermined thresholds may therefore influence printer operation. The response to these thresholds may be different for duplex first side, duplex second side, and simplex operations.

As the first image of the duplex image is being transfixed at the selected transfix operation mode and speed, the back side array cells are updated to the current values of the corresponding cells in the roller zone array. That is, sb(n)=rz(n). The roller regions are then updated. In one embodiment, if the entire roller region is outside the width of the media sheet being printed, then the roller region cell is set to three. This value reflects the exposure of the transfix roll to release agent during a transfix operation because no media sheet is interposed between the imaging member and the transfix roll in that region. Otherwise, the current roller region value is decremented by one to reflect the back of the sheet absorbing release agent from the transfix roll. In this embodiment, the roller region cannot be decremented lower than zero. When the second image of a duplex image is being transfixed, then the updating shown in block 144 is different. Specifically, the value of the corresponding cell in the last image array is added to the current value of the corresponding roller region cell and the corresponding back side region cell. In one embodiment of the process shown in FIG. 2, the last image update is performed following the transfixing of the first image to the media sheet by setting each cell in the last image array to the value of the corresponding cell in the current image array. That is, li(n)=ci(n).

The at risk analysis of block 136 is implemented in one embodiment by calculating the percentage of pixels to be printed in each region of the second image of the duplex image, comparing the percentages to the pair of thresholds, and setting the current image cell values to either a zero, one, or two as discussed above. If no cell has a value of two, then the release agent is applied to the imaging member in the "overlap with image" mode and the imaging member and transfix roll are operated at the simplex speed for the transfix operation for all pitches on the imaging member. If any current image cell has a value of two, then the back side array is considered in the evaluation. In one embodiment, this evaluation is implemented by multiplying each current image cell by the value of the corresponding cell in the back side array. This product is then compared to a predetermined threshold. In one embodiment, if any product is equal to or greater than two, the "on-the-fly" mode of applying release agent is used and the imaging member and transfix roll are operated differently for transfer of the ink images. In one implementation, the first pitch on the imaging member is transferred to the media sheet by operating the imaging member and transfix roll at the simplex speed, while the second pitch is transferred at a slower rotational speed. For example, the first pitch may be transfixed at 26 inches per second and the second pitch may be transfixed at 8 inches per second. The "on the fly" mode operation speed for the imaging member is 1000 mm/second in one embodiment.

In one implementation of the process for evaluating image content to select rotational speed for the imaging member and transfix roll, the process may be selectively set to default conditions. When the default conditions are used, the release agent is applied to the imaging member for generation of the first image in a duplex image in the "on the fly" mode of operation at a rotational speed of 500 mm/second. The first image may be transfixed by operating the imaging member and transfix roll at a rotational speed of 40 inches per second. The release agent is applied to the imaging member before generation of the second image of a duplex image using the "overlap with image" mode of operation and the second image is transfixed to the back side of the media sheet by operating the imaging member and transfix roll at a rotational speed of 26 inches per second.

Figure 3:
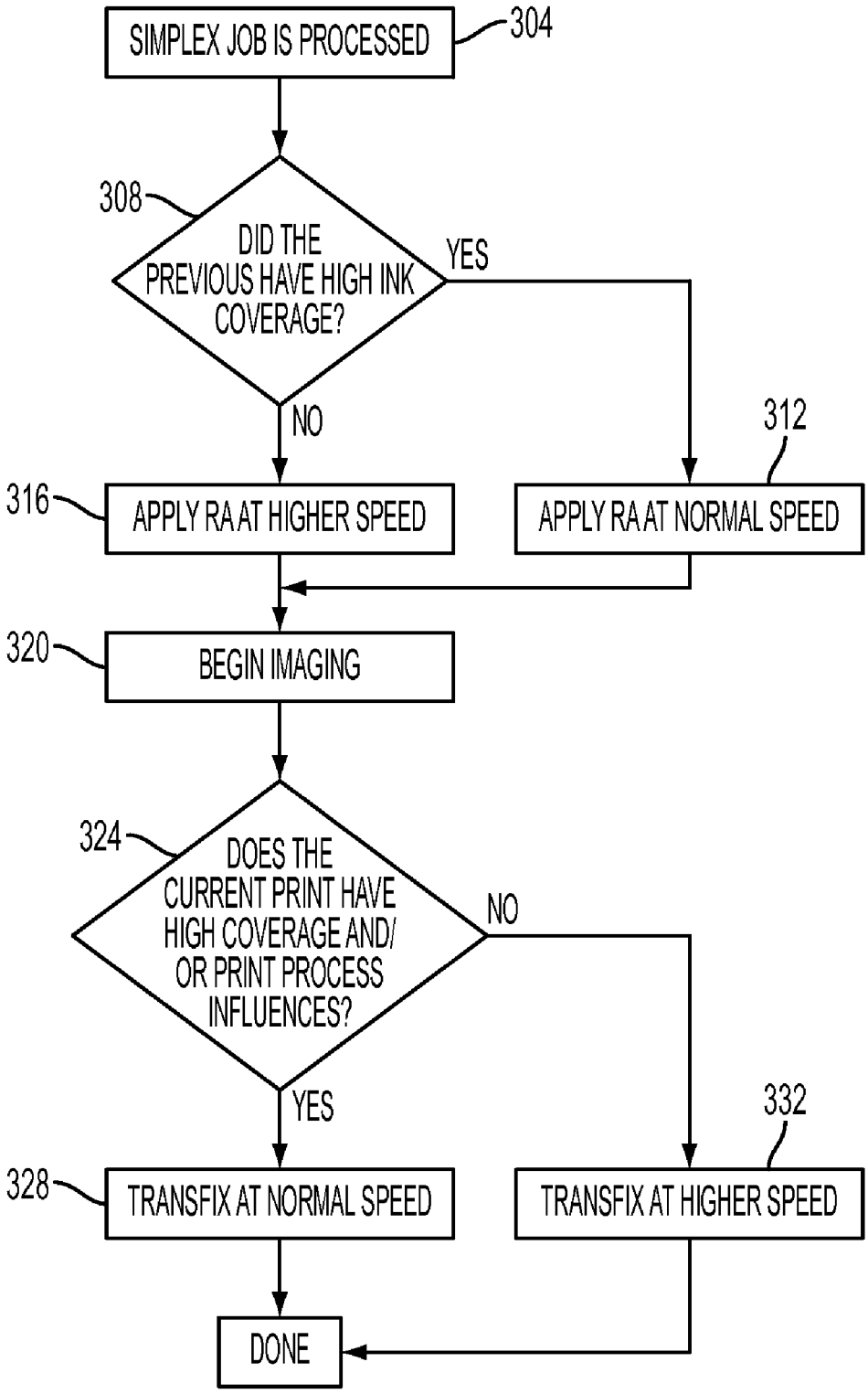
FIG. 3 is a flow diagram of a method that evaluates image content of simplex images to control the rotational speed of at least one of the image receiving member and the transfix roll.

A process that may be used to control a printing process for simplex prints is shown in FIG. 3. The process detects a simplex print job to be processed (block 304). After measuring the image content of the print image, the process determines whether the image content exceeds a predetermined threshold (block 308). The measurement of image content may include measurements or historical scores for prior images and these measurements may be updated with the measurement of a current image. As depicted in the figure, this comparison determines whether the print image has high ink coverage. If the image content indicates high ink coverage, then release agent is applied to the image receiving member at a normal speed (block 312). In response to the print image not having high ink coverage, release agent is applied to the image receiving member at a speed, which is greater than the normal speed (block 316). The process continues by executing the print image (block 320) and determining whether the image has high ink coverage or high influence on the printing process (block 324). If it does, the image is transfixed to media at normal speed (block 328). Otherwise, it is transfixed at a speed greater than the normal speed (block 332). Again, the ink coverage or influence may include measurements or historical scores that reference prior images and these measurements or scores may be updated with reference to a current image.

Figure 4:
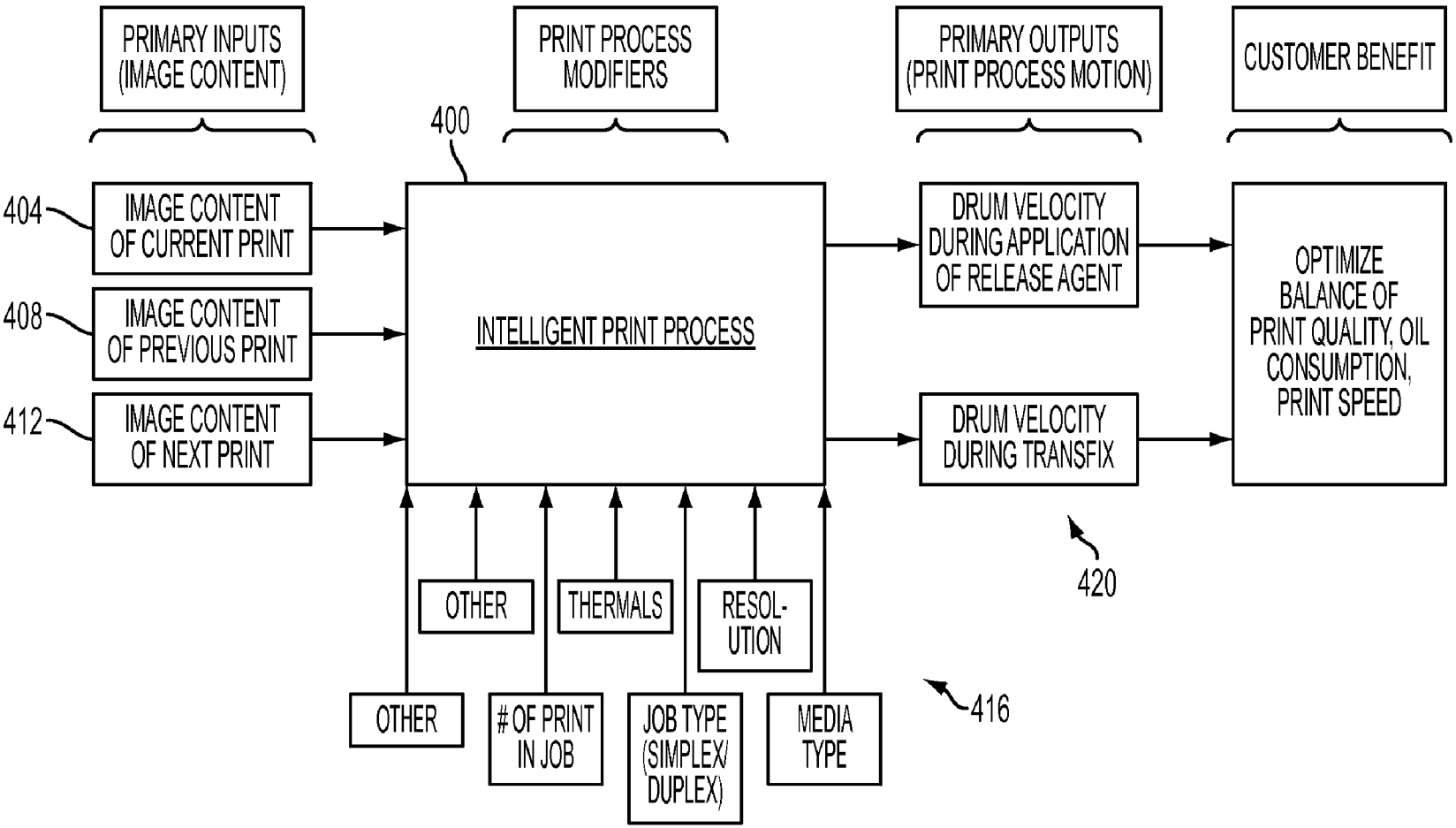
FIG. 4 is a diagram showing how print process parameter modifiers influence process control with reference to image content.

Both the process for controlling a printing process described with reference to duplex image printing and simplex image printing may be illustrated with a process influence chart, such as the one shown in FIG. 4. The control process, denoted as an intelligent print process 400, may receive one or more of the measurements of image content for a current print 404, a previous print image 408, and a next print image 412. Other parameters 416 are referenced or sampled to aid in the analysis and determination of an optimized image process. These parameters may include resolution of each image, the type of media to which the images are to be transfixed, the type of print job, such as duplex or simplex, the number of images in the print job, and thermal measurements at various locations in the printer, and may include numerous additional considerations, such as user preference for the speed/quality trade off, identical image repetitions and so forth, referenced here with the placeholder "other" in the box of FIG. 4. The control process 400 implements logical decisions and analysis made with reference to these measurements and parameters to select and perform control actions 420. The control actions depicted in FIG. 4 include control of the image receiving member rotational speed during application of release agent to the member and control of the image receiving member rotational speed during a transfix operation. The parameters for these control actions are made in accordance with the objective of balancing print quality, consumption of release agent, and print speed.

In operation, programmed instructions for performing the process to evaluate image content in printing operations to control the rotational speed of the imaging member during transfix and release agent application operations are stored in the program memory for a printer controller. By configuring the controller in this manner, the controller detects a printing operation, evaluates the image content of the one or more images in a print job, updates historical records for the influencing values, and controls the rotational speed of the imaging member and transfix roll appropriately. This control maintains acceptable image quality, partially by attenuating image dropout, provides minimal loss in printer throughput by operating at the fastest practical speeds, and minimizes consumption of non beneficial release agent volumes by applying less than nominal volumes when compromises are negligible.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed:

1. A method for optimizing the print process of an ink jet printer comprising:

measuring image content of a first print image;

comparing the measured image content to a predetermined threshold;

altering a print process parameter to adjust operation of a printer component in response to the measured image content exceeding the threshold;

detecting a duplex print image; and the alteration of the print process parameter includes modifying rotational speed of an image receiving member for a release agent application in response to the measured image content exceeding the predetermined threshold.

2. The method of claim 1 wherein the image content is a number of pixels to be printed for the first print image.

3. The method of claim 1 further comprising:

measuring image content for a second print image;

comparing the measured image content for the second print image to the predetermined threshold; and altering rotational speed of an image receiving member for at least one of a release agent application and a transfix operation in response to the measured image content for the second print image exceeding the predetermined threshold.

4. The method of claim 1 further comprising:

measuring image content for a second print image;

comparing the measured image content for the second print image to the predetermined threshold; and altering rotational speed of an image receiving member for at least one of a release agent application and a transfix operation in response to the measured image content for one of the print image and the second print image exceeding the predetermined threshold.

5. The method of claim 4, the image content measurement further comprising:

measuring image content in each region of a plurality of regions in the first print image and the second print image;

comparing each measured image content parameter to a predetermined region threshold; and altering the rotational speed of the image receiving member for at least one of the release agent application and the transfix operation in response to the measured image content for one of the regions exceeding the predetermined threshold.

6. The method of claim 5 wherein the predetermined region threshold for one of the regions is different than the predetermined region threshold for another one of the regions.

7. The method of claim 5 further comprising:

generating a score for each region in a plurality of regions on the transfix roll that corresponds to a release agent accumulation on the transfix roll; and modifying the generated score for each region on the transfix roll with reference to the measured image content for at least one region in one of the first and the second print images.

8. The method of claim 7 further comprising:

altering the rotational speed for the image receiving member for the transfix operation in response to the modified score for one of the transfix roll regions exceeding a predetermined threshold.

9. The method of claim 7 further comprising:

altering the rotational speed for the image receiving member during application of release agent to the image receiving member in response to the modified score for one of the transfix roll regions exceeding a predetermined threshold.

10. A method for optimizing a printing process of an ink jet printer comprising:

measuring image content for a first print image;

comparing the measured image content for the first print image to a first predetermined threshold; and altering a rotational speed of an image receiving member for a release agent application in response to the measured image content exceeding the predetermined threshold.

11. The method of claim 10, the image content measuring further comprising:

measuring image content for each region in a plurality of regions in the first print image;

comparing the measured image content for each region of the first print image to the predetermined threshold; and altering the rotational speed of the image receiving member for at least one of a release agent application and a transfix operation in response to the measured image content for one of the regions in the first print image exceeding the predetermined threshold.

12. The method of claim 11 further comprising:

updating a back side score for each region in a plurality of back side regions with reference to a transfix roll score for a corresponding region in a plurality of transfix roll regions, the transfix roll score corresponding to a release agent accumulation on the transfix roll; and revising the transfix roll score for each region in the plurality of transfix roll regions.

13. The method of claim 12, the transfix roll score revision further comprising:

revising the transfix roll score for each region with reference to a last printed image score; and updating the last printed image score for each region with the generated score for each region of a current print operation.

14. The method of claim 13 further comprising:

comparing measured image content for each region of a second print image to a second predetermined threshold; and altering the rotational speed of the image receiving member for at least one of a release agent application and a transfix operation to print the second print image in response to the measured image content for one of the regions in the second print image exceeding the second predetermined threshold.

15. The method of claim 14 further comprising:

calculating a transfix roll score for each region of the second print image with reference to the measured image content for each corresponding region in the second print image and to the back side score for each corresponding region in the plurality of back side regions; and comparing the transfix roll score for each region of the second print image to a predetermined back side threshold.

16. The method of claim 15 further comprising:

altering the rotational speed of the image receiving member for at least one of a release agent application and a transfix operation in response to the transfix roll score for one of the regions of the second print image exceeding the predetermined back side threshold.

17. The method of claim 16 further comprising:

altering the rotational speed of the image receiving member during application of release agent to the image receiving member in response to the transfix roll score for one of the regions of the second print image exceeding the predetermined back side threshold.

18. An ink jet printer having multiple transfixing modes and multiple release agent application modes comprising:

a rotatable image receiving member having a coating of release agent thereon;

a print head adjacent said rotatable image receiving member for ejecting ink droplets thereon to form ink images on said rotatable image receiving member, said ink images having a top edge;

a transfix roll located adjacent said rotatable image receiving member and downstream from said print head, the transfix roll being adapted for movement towards and away from said rotatable image receiving member in order to form a transfixing nip periodically with the rotatable image receiving member;

a release agent applicator configured to selectively engage the rotatable image receiving member to apply release agent to the rotatable imaging member; and a controller configured to analyze image content of at least one print image and to alter rotational speed of the rotatable image receiving member for a release agent application in response to the image content of the at least one print image exceeding a predetermined threshold.

19. The ink jet printer of claim 18, the controller being further configured to maintain a transfix roll score corresponding to an amount of release agent on the transfix roll and to alter at least one printing process parameter with reference to the transfix roll score.

* * * * *